US006935516B2

(12) United States Patent
Chiang

(10) Patent No.: US 6,935,516 B2
(45) Date of Patent: Aug. 30, 2005

(54) TOOL HOLDING AND DISPLAYING DEVICE

(76) Inventor: Kuo Chuan Chiang, P.O. Box 63-298, Taichung (TW), 406

( * ) Notice: Subject to any disclaimer, the term of this patent is extended or adjusted under 35 U.S.C. 154(b) by 59 days.

(21) Appl. No.: 10/670,706

(22) Filed: Sep. 23, 2003

(65) Prior Publication Data

US 2005/0061757 A1 Mar. 24, 2005

(51) Int. Cl.[7] ..... A47F 7/00
(52) U.S. Cl. ..... 211/70.6; 206/349
(58) Field of Search ..... 211/70.6, 69; 403/282, 403/326, 331, 353, 381; 248/688, 349, 377, 309.1, 222.11, 222.12, 214, 682, 693, 317; 206/376, 346, 377, 806, 495, 349, 477–479, 480–482

(56) References Cited

U.S. PATENT DOCUMENTS 5,906,350 A 5/1999 Kao ..... 248/688
5,996,817 A 12/1999 Kao ..... 211/70.6
6,193,200 B1 2/2001 Kao ..... 248/309.1
6,202,865 B1 * 3/2001 Kuo ..... 211/70.6
6,378,700 B1 4/2002 Tong ..... 206/376
6,679,379 B1 * 1/2004 Kao ..... 206/349
6,719,154 B2 * 4/2004 Kao ..... 211/70.6
6,742,653 B2 * 6/2004 Kao ..... 206/373
2002/0175257 A1 * 11/2002 Yen ..... 248/309.1

* cited by examiner

*Primary Examiner*—Jennifer E. Novosad
(74) *Attorney, Agent, or Firm*—Charles E. Baxley

(57) ABSTRACT

A tool holding and displaying device includes a plate having a narrower neck portion formed between an upper orifice and a lower aperture. The upper orifice of the plate includes an inner diameter greater than that of the lower aperture of the plate, and a bracket includes a latch having an enlarged head formed on a pin for engaging into the upper orifice of the plate. The enlarged head of the latch is greater than the lower apertures of the plate, to engage with the plate, and to anchor the bracket to the plate. The plate includes one or more spring arms to engage with the pin of the latch of the bracket, to lock the latch of the bracket to the plate.

6 Claims, 9 Drawing Sheets

TOOL HOLDING AND DISPLAYING DEVICE

BACKGROUND OF THE INVENTION

1. Field of the Invention

The present invention relates to a tool holding and displaying device, and more particularly to a tool holding and displaying device for locking tools, and for allowing the tools to be removed from the displaying device when required.

2. Description of the Prior Art

Various kinds of typical tool holding and displaying devices have been developed for locking tools with an anti-theft locking device, and for allowing the tools to be removed from the displaying device when required.

For example, U.S. Pat. No. 5,996,817 to Kao discloses one of the typical tool holding and displaying devices comprising a supporting bracket having two stubs for engaging through holes of suspension plates, and for attaching or supporting tools to the suspension plates.

However, the stubs should be cut from the supporting bracket before the tools may be disengaged from the supporting bracket. The supporting bracket may no longer be attached to or supported by the suspension plates, and the tools may no longer be held or supported or displayed with the suspension plates after the stubs have been cut from the supporting bracket.

U.S. Pat. No. 6,193,200 to Kao discloses another typical tool holding and displaying device comprising a supporting bracket having two hooks for engaging through slots of suspension plates, and for attaching or supporting tools to the suspension plates.

However, the hooks may be easily disengaged from the supporting bracket, and may not be provided for anti-theft purposes, such that additional anti-theft devices are required to be attached to the suspension plates and the supporting bracket, in order to secure the suspension plates and the supporting bracket together.

U.S. Pat. No. 5,906,350 to Kao discloses a further typical tool holding and displaying device comprising a supporting bracket having two hooks for engaging through slots of suspension plates, and having two snapping members for securing the suspension plates and the supporting bracket together, and for attaching or supporting tools to the suspension plates.

However, the snapping members should be cut from the supporting bracket before the tools may be disengaged from the supporting bracket. The hooks may be provided to support the tools to the suspension plates, but may not be easily engaged into the suspension plates.

U.S. Pat. No. 6,378,700 to Tong discloses a still further typical tool holding and displaying device comprising a suspension plate having two hooks or catches for engaging through slots of supporting brackets, and for attaching or supporting tools to the suspension plates.

However, the hooks or catches may not be easily disengaged from the supporting bracket when required, and the tools also may not be easily disengaged or removed from the suspension plates in order to obtain the tools from the suspension plates.

The present invention has arisen to mitigate and/or obviate the afore-described disadvantages of the conventional tool holding and displaying devices.

SUMMARY OF THE INVENTION

The primary objective of the present invention is to provide a tool holding and displaying device for locking tools with an anti-theft locking device, and for allowing the tools to be removed from the displaying device when required.

The other objective of the present invention is to provide a tool holding and displaying device for supporting the tools after the anti-theft locking device has been cut or damaged by the users.

In accordance with one aspect of the invention, there is provided a tool holding and displaying device comprising a plate including at least one locking groove formed therein, the locking groove of the plate including an upper orifice and a lower aperture formed therein and communicating with each other to form a narrower neck portion between the upper orifice and the lower aperture of the plate. The upper orifice of the plate includes an inner diameter greater than that of the lower aperture of the plate, and a bracket may be used for supporting tools, the bracket includes a latch having a pin extended from the bracket and an enlarged head formed on the pin for engaging into the upper orifice of the locking groove of the plate, the pin includes an outer diameter no greater than an inner diameter of the lower aperture of the plate, for allowing the pin to be received in the lower aperture of the plate, and the enlarged head of the latch includes an outer diameter no greater than an inner diameter of the upper orifices of the plate, but greater than the inner diameter of the lower apertures of the plate, to allow the enlarged head of the latch to engage through the upper orifice of the plate, but unable to engage through the lower apertures of the plate, and the plate includes at least one slot formed beside the locking groove thereof, to form at least one spring arm and to define the neck portion of the locking groove of the plate. The spring arm of the plate is engageable with the pin of the latch of the bracket, to lock the latch of the bracket to the plate.

The plate further includes an opening formed therein and communicating with the slot of the plate, for receiving cutting tools. The plate includes at least one plier pattern provided thereon to indicate the opening of the plate. The latch includes at least one lock notch formed in the pin thereof, to receive the spring arm of the plate, and to anchor the bracket to the plate.

The bracket includes a frame having a chamber formed therein for receiving the tools, and having at least one ear extended from the frame, the latch is extended from the ear of the bracket. A board attached to the plate, the board including at least one peg extended from the board for supporting the tools.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
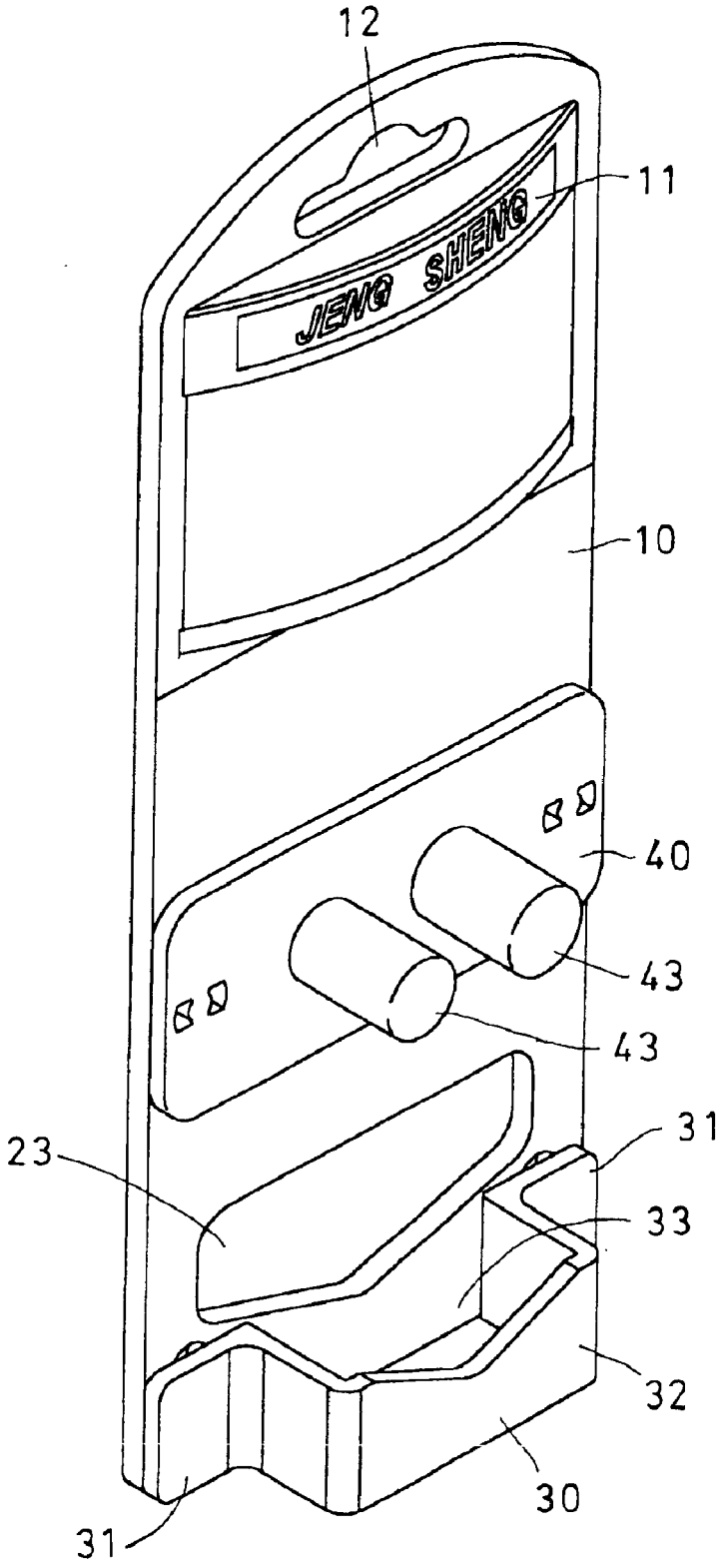
FIG. 1 is a perspective view of a tool holding and displaying device in accordance with the present invention.
Figure 2:
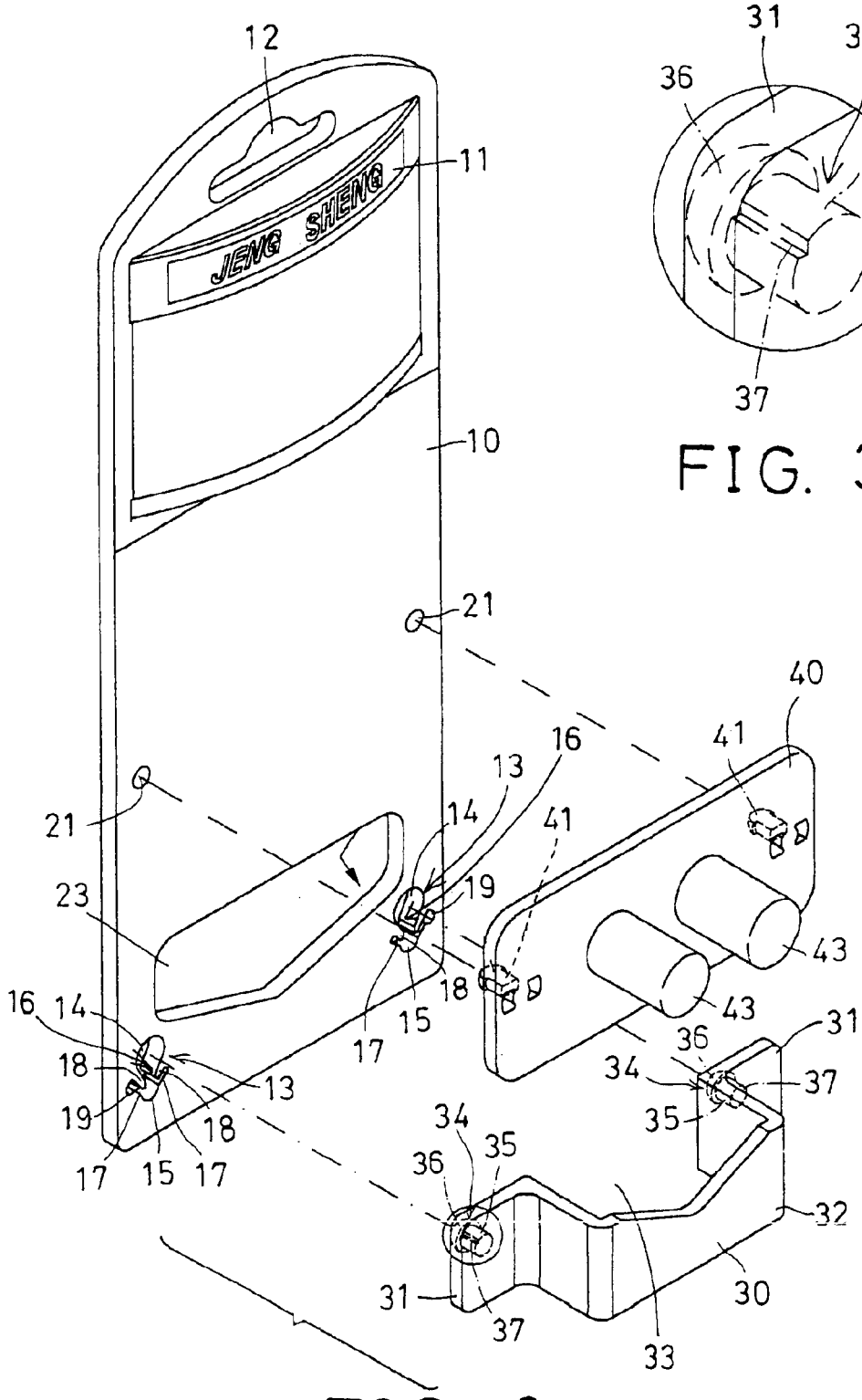
FIG. 2 is an exploded view of the tool holding and displaying device.
Figure 3:
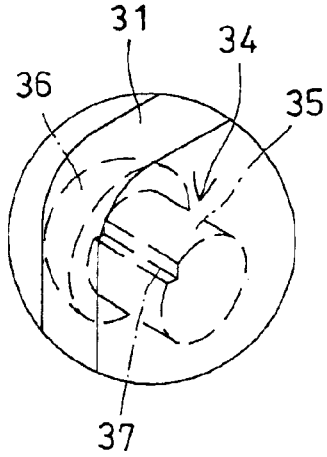
FIG. 3 is an enlarged partial perspective view of the tool holding and displaying device.
Figure 4:
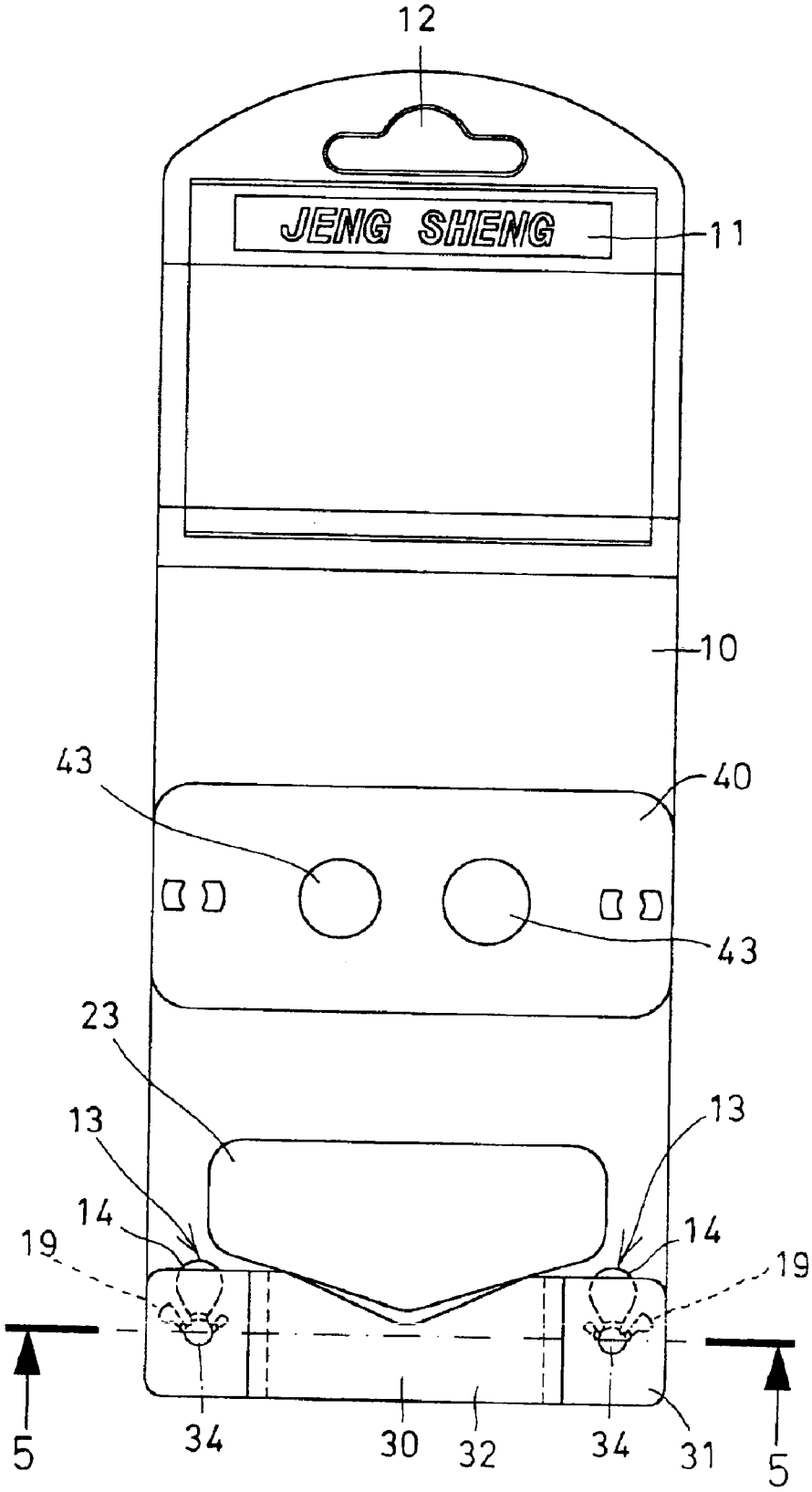
FIG. 4 is a front plan view of the tool holding and displaying device.
Figure 5:
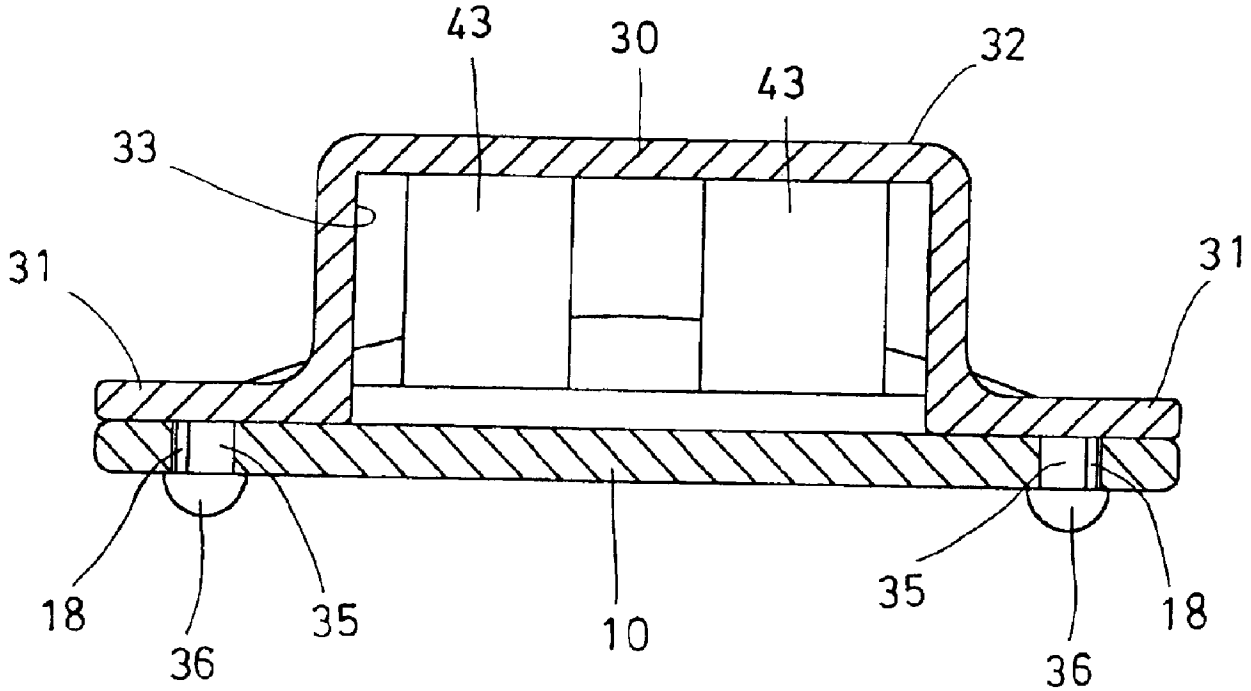
FIG. 5 is a cross sectional view of the tool holding and displaying device, taken along lines 5—5 of FIG. 4.

Referring to the drawings, and initially to FIGS. 1–6, a tool holding and displaying device in accordance with the present invention comprises a suspension plate 10 including an area 11 for applying with different patterns, colors, or the like, or for attaching marks thereon, and including a suspension slot 12 formed therein for hanging or suspension purposes.

The plate 10 further includes one or more, such as two locking grooves 13 formed therein, and each having an upper orifice 14 and a lower aperture 15 formed therein and communicating with each other, to form a narrower neck portion 16 therebetween. The upper orifice 14 of the plate 10 includes an inner diameter greater than that of the lower aperture 15 of the plate 10.

The plate 10 further includes two slots 17 formed on both sides of each of the locking grooves 13 thereof, in order to form or define two spring arms 18 which may also be used to form or define the narrower neck portion 16 of the locking grooves 13 respectively. The plate 10 further includes an opening 19 formed therein and communicating with one of the slots 17 of each of the locking grooves 13 thereof.

Figure 8:
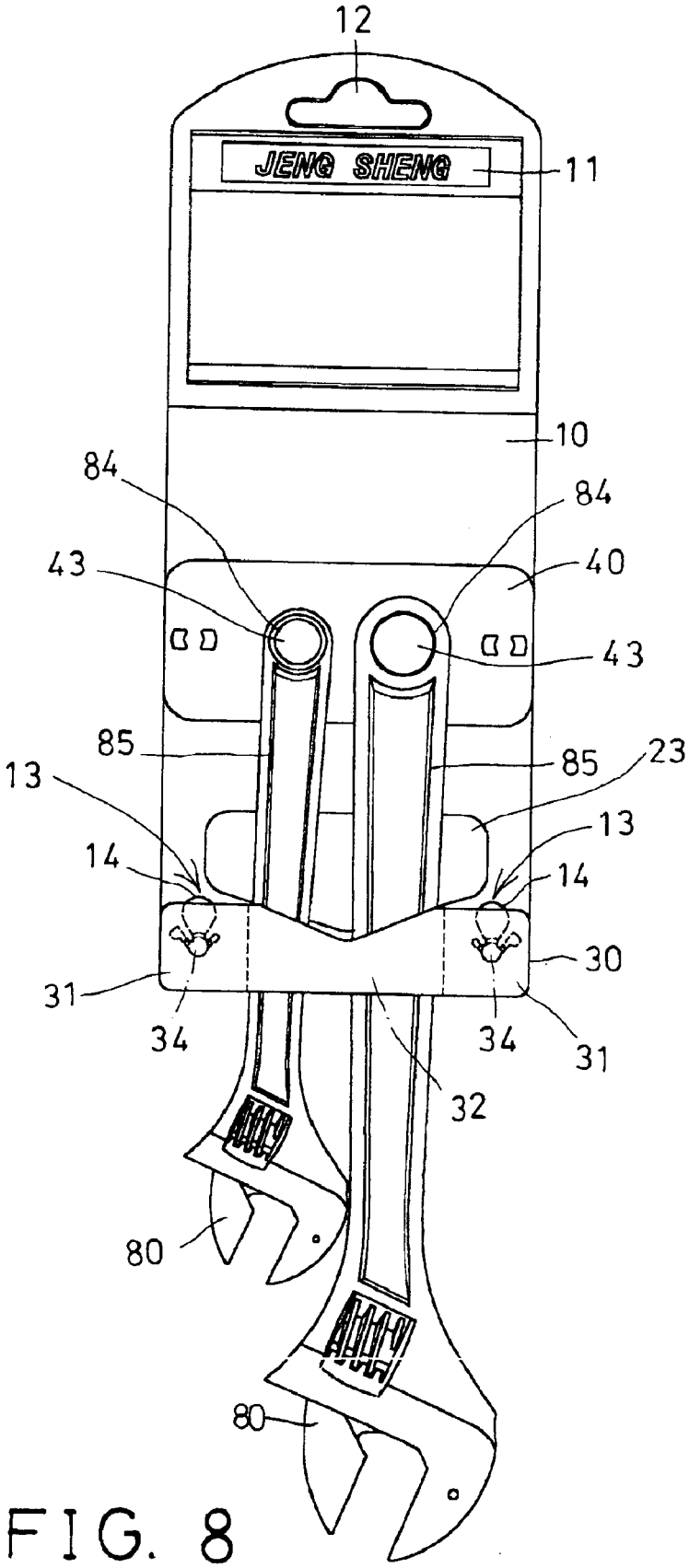
FIGS. 8, 9 are front plan views illustrating the operation of the tool holding and displaying device.

A supporting bracket 30 includes two ears 31 extended or provided on two sides of a frame 32, in order to form or define a chamber 33 therein which may be used for receiving and confining tools 80 therein, such as the wrenches 80 as shown in FIG. 8; and includes a latch 34 provided on each of the ears 31 for engaging with the locking grooves 13 of the plate 10, and for attaching the bracket 30 to the plate 10.

Each of the latches 34 includes a pin 35 extended from the ear 31 of the bracket 30, and an enlarged head 36 formed on the free end of the pin 35 for engaging into the orifices 14 of the respective locking grooves 13 of the plate 10. The pin 35 includes an outer diameter no greater than the inner diameter of the lower aperture 15 of the plate 10, for allowing the pin 35 to be received in the lower aperture 15 of the plate 10.

The enlarged heads 36 of the latches 34 includes an outer diameter no greater than the inner diameter of the upper orifices 14 of the plate 10, but greater than the inner diameter of the lower apertures 15 of the plate 10, for allowing the enlarged heads 36 of the latches 34 to be engageable through the upper orifices 14 of the plate 10, but may not be engaged through the lower apertures 15 of the plate 10.

Figure 6:
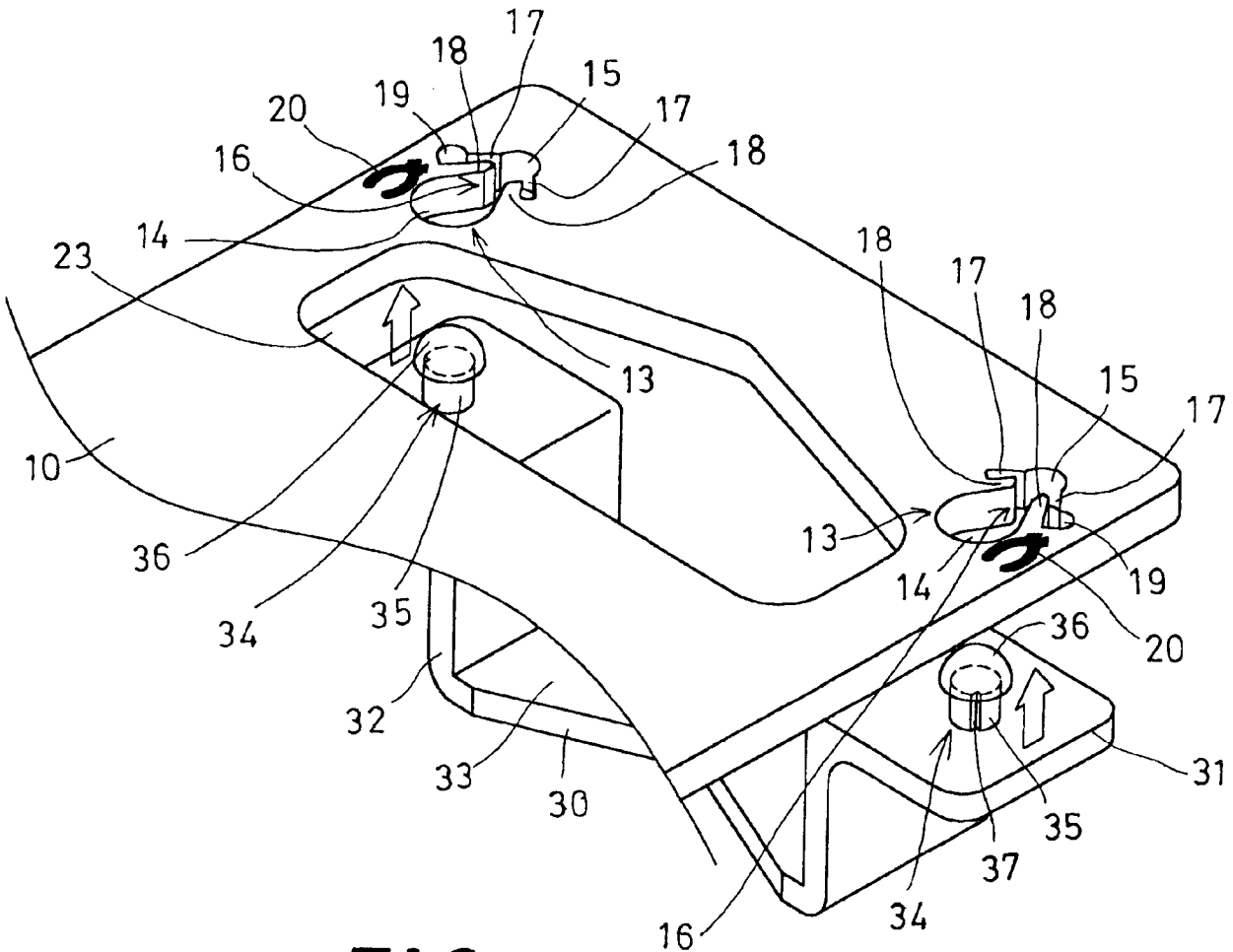
FIGS. 6, 7 are partial perspective views illustrating the operation of the tool holding and displaying device.
Figure 7:
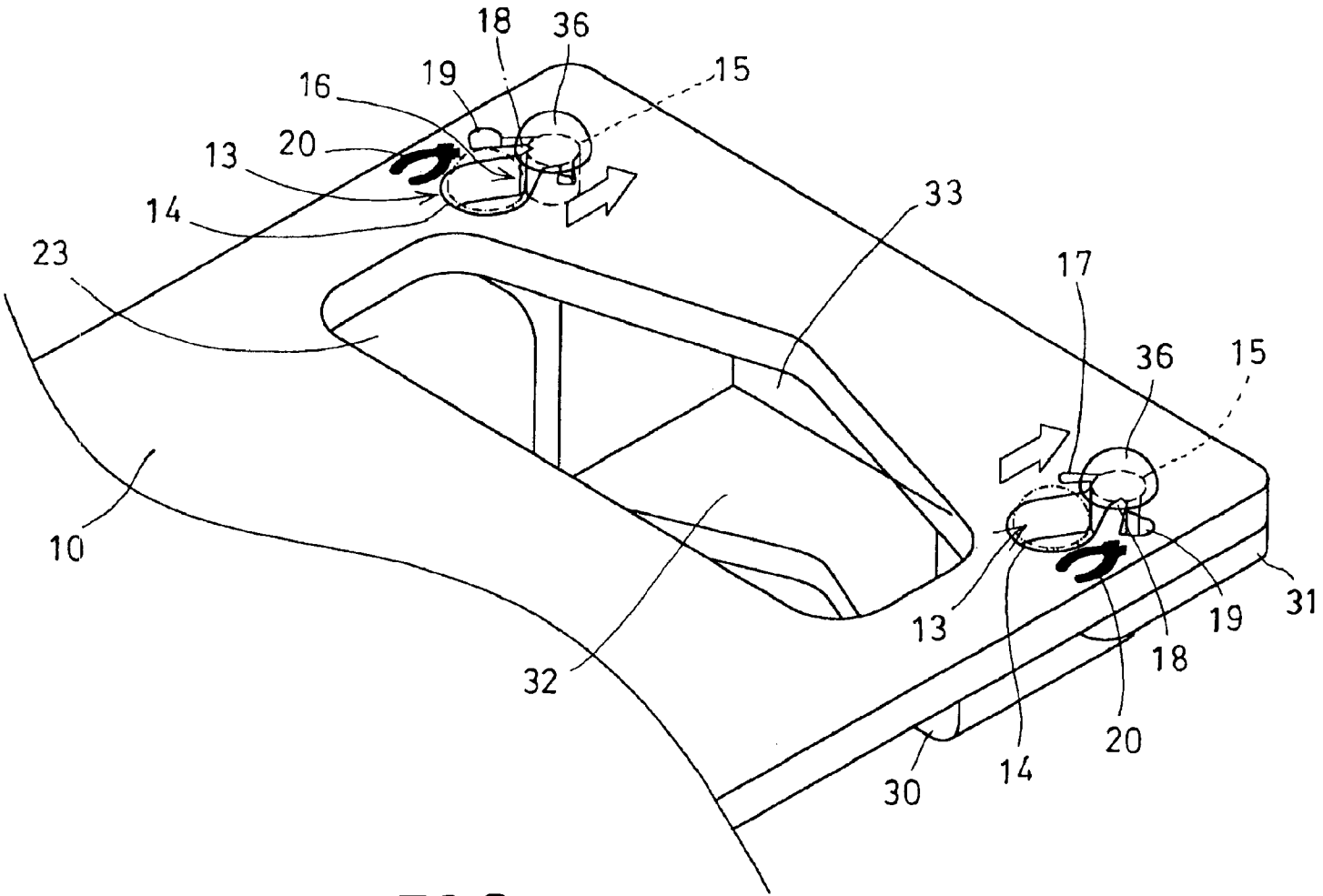

In operation, as shown in FIGS. 6 and 7, the enlarged heads 36 of the latches 34 may be engaged through the upper orifices 14 of the plate 10, and the pins 35 of the latches 34 may then be engaged into the lower apertures 15 of the plate 10 respectively. The enlarged heads 36 of the latches 34 includes an outer diameter greater than the inner diameter of the lower apertures 15 of the plate 10, such that the enlarged heads 36 of the latches 34 may be engaged with the plate 10 (FIG. 5), to anchor or secure the bracket 30 to the plate 10.

After the pins 35 of the latches 34 have been engaged into the lower apertures 15 of the plate 10, the spring arms 18 of the plate 10 may be engaged with the pins 35 of the latches 34, so as to anchor or lock the latches 34 and thus the bracket 30 to the plate 10. It is preferable that each of the latches 34 further includes one or more lock notches 37 formed in the pin 35 thereof (FIGS. 2, 3, 7), to receive the spring arms 18 of the plate 10 (FIGS. 7, 10), and to further solidly anchor or lock the bracket 30 to the plate 10.

Figure 10:
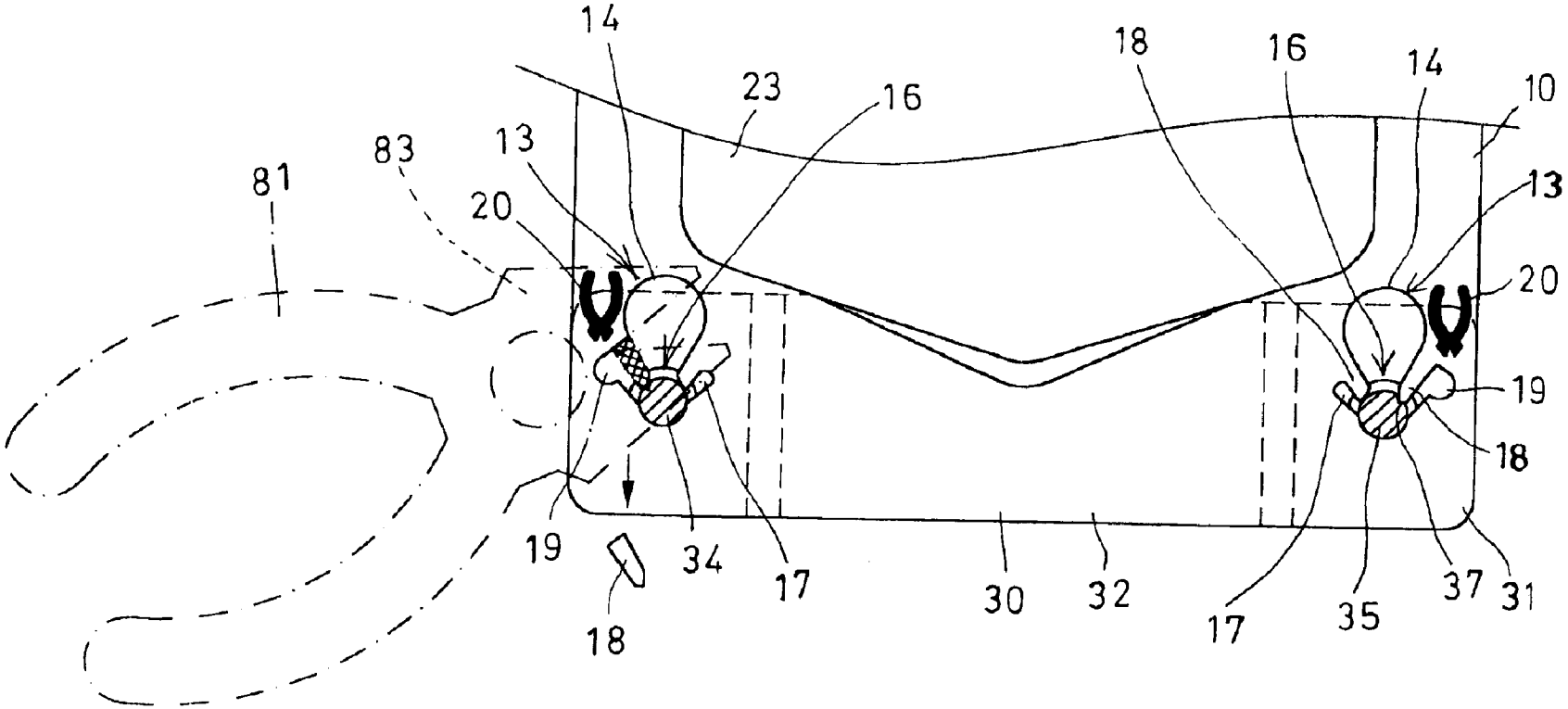
FIG. 10 is an enlarged partial cross sectional view illustrating the operation of the tool holding and displaying device.

As shown in FIG. 10, when it is required to remove the tools 80 from the bracket 30, or when it is required to remove the bracket 30 from the plate 10, a plier device or cutter device or shear device 81 may have its cutter blades 83 engaged through the upper orifice 14 and the opening 19 of the plate 10, in order to cut off one or both of the spring arms 18 from the plate 10, and thus for allowing the pins 35 of the latches 34 to be disengaged from the lower apertures 15 of the plate 10.

The enlarged heads 36 of the latches 34 may thus be disengaged from the plate 10 via the upper orifices 14 of the plate 10, after either or both of the spring arms 18 have been cut off from the plate 10. It is to be noted that the pins 35 of the latches 34 may also be engaged into the lower apertures 15 of the plate 10, in order to secure the bracket 30 and the tools 80 to the plate 10, even after the spring arms 18 have been cut off from the plate 10.

The plate 10 includes one or more plier patterns 20 provided thereon (FIGS. 6, 7, 10), to indicate the upper orifice 14 and the opening 19 of the plate 10, and to guide the users to engage the cutter blades 83 through the upper orifice 14 and the opening 19 of the plate 10, and to cut off either or both of the spring arms 18 from the plate 10. The plate 10 further includes one or more holes 21 formed therein for supporting a board 40 thereto.

For example, the board 40 includes one or more catches 41 extended therefrom and engaged into the holes 21 of the plate 10, to detachably secure or attach the board 40 to the plate 10; and includes one or more pegs 43 extended therefrom for supporting the tools 80 (FIG. 8). For example, each of the tools 80 includes a bore 84 formed in a shank 85 thereof, to receive the pegs 43, and to secure or anchor the tools 80 to the plate 10. The plate 10 may include an opening 23 formed therein for weight reducing or for decorative purposes.

Figure 9:
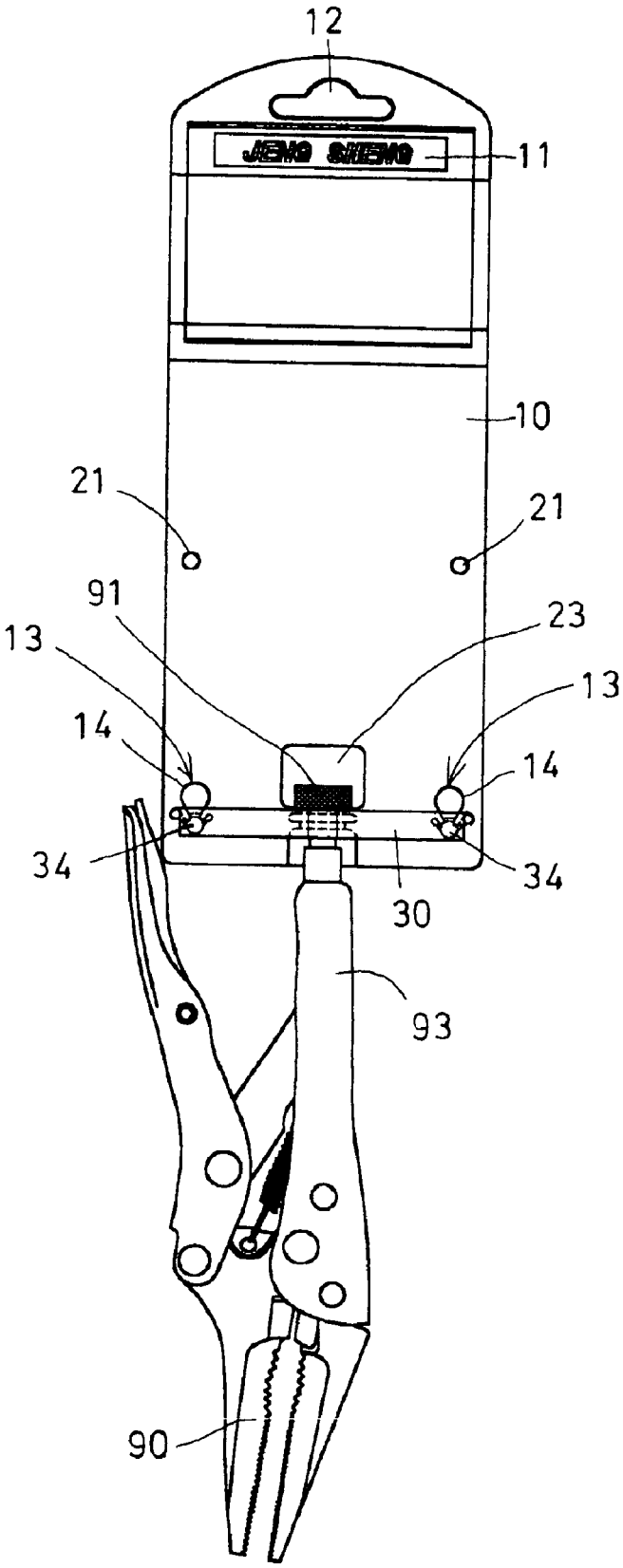

Alternatively, as shown in FIG. 9, the opening 23 of the plate 10 may be used to receive an adjusting screw 91 of another tool 90, and the bracket 30 may be attached to the plate 10 for securing the shank 93 of the tool 90 to the plate 10, and may be secured to the plate 10 with the latches 34

Accordingly, the tool holding and displaying device in accordance with the present invention may be provided for locking tools with an anti-theft locking device, and for allowing the tools to be removed from the displaying device when required, and may be provided for supporting the tools after the anti-theft locking device has been cut or damaged by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool holding and displaying device comprising:

a plate including at least one locking groove formed therein, said at least one locking groove of said plate including an upper orifice and a lower aperture formed therein and communicating with each other to form a neck portion between said upper orifice and said lower aperture of said plate, and said upper orifice of said plate including an inner diameter greater than that of said lower aperture of said plate, a bracket for supporting tools, said bracket including a latch having a pin extended from said bracket and an enlarged head formed on said pin for engaging into said upper orifice of said at least one locking groove of said plate, said pin including an outer diameter no greater than an inner diameter of said lower aperture of said plate, for allowing said pin to be received in said lower aperture of said plate, and said enlarged head of said latch including an outer diameter no greater than an inner diameter of said upper orifices of said plate, but greater than said inner diameter of said lower apertures of said plate, to allow said enlarged head of said latch to engage through said upper orifice of said plate, but unable to engage through said lower apertures of said plate, and said plate including at least one slot formed beside said at least one locking groove thereof, to form at least one spring arm between said at least one slot and said at least one locking groove thereof, and to define said neck portion of said at least one locking groove of said plate, said at least one spring arm of said plate being engageable with said pin of said latch of said bracket, to lock said latch of said bracket to said plate.

2. The tool holding and displaying device as claimed in claim 1, wherein said plate further includes an opening formed therein and communicating with said at least one slot of said plate, for receiving cutting tools.

3. The tool holding and displaying device as claimed in claim 2, wherein said plate includes at least one plier pattern provided thereon to indicate said opening of said plate.

4. The tool holding and displaying device as claimed in claim 1, wherein said latch includes at least one lock notch formed in said pin thereof, to receive said at least one spring arm of said plate, and to anchor said bracket to said plate.

5. The tool holding and displaying device as claimed in claim 1, wherein said bracket includes a frame having a chamber formed therein for receiving the tools, and having at least one ear extended from said frame, said latch is extended from said at least one ear of said bracket.

6. The tool holding and displaying device as claimed in claim 1 further comprising a board attached to said plate, said board including at least one peg extended from said board for supporting the tools.

* * * * *